US008985644B2

(12) United States Patent
Manny et al.

(10) Patent No.: US 8,985,644 B2
(45) Date of Patent: Mar. 24, 2015

(54) BARRIER RELEASE MECHANISM

(75) Inventors: Justin Luke Manny, Greystanes (AU); Carlos Alfred Freund, Fairfield West (AU); Michael John Watmough, Bilgola Plateau (AU)

(73) Assignee: Breakout Barrier Release Systems Pty. Ltd., Wentworthville (AU)

( * ) Notice: Subject to any disclaimer, the term of this patent is extended or adjusted under 35 U.S.C. 154(b) by 0 days.

(21) Appl. No.: 13/399,563

(22) Filed: Feb. 17, 2012

(65) Prior Publication Data

US 2012/0205921 A1 Aug. 16, 2012

Related U.S. Application Data

(63) Continuation of application No. 10/556,701, filed as application No. PCT/AU2004/000617 on May 12, 2004, now abandoned.

(30) Foreign Application Priority Data

May 12, 2003 (AU) ..... 2003902273

(51) Int. Cl.

| | |
|---|---|
| ***E05C 1/12*** | (2006.01) |
| ***F15B 15/10*** | (2006.01) |
| ***E05B 51/02*** | (2006.01) |
| *E05B 15/10* | (2006.01) |
| *E05B 63/24* | (2006.01) |
| *E05B 65/10* | (2006.01) |

(52) U.S. Cl.

CPC ..... *F15B 15/103* (2013.01); *E05B 51/02* (2013.01); *E05B 15/101* (2013.01); *E05B 63/246* (2013.01); *E05B 65/1033* (2013.01)

USPC ..... 292/164; 292/144; 292/84

(58) Field of Classification Search

CPC ..... E05B 1/02; E05B 77/50; E05B 81/10; E05B 2051/026

USPC ..... 292/144, 85, 125, 171

See application file for complete search history.

(56) References Cited

U.S. PATENT DOCUMENTS

| | | | |
|---|---|---|---|
| 2,843,151 | A | 7/1958 | Greenawalt |
| 3,367,575 | A | 2/1968 | Davis |
| 3,759,556 | A | 9/1973 | Wright |

(Continued)

FOREIGN PATENT DOCUMENTS

| | | |
|---|---|---|
| DE | 2716683 | 10/1977 |
| DE | 10228978 | 12/2003 |

(Continued)

OTHER PUBLICATIONS

PCT International Search Report dated Jun. 7, 2005.

(Continued)

*Primary Examiner* — Mark Williams

(74) *Attorney, Agent, or Firm* — McCarter & English, LLP

(57) ABSTRACT

A barrier release mechanism for a construction including a barrier and frame has a latch biased towards an unlatching position. An actuation device adjacent the construction is movable, under pressure from a fluid pressure source, into an engaged position in abutment with the latch to urge the latch against the bias to cause constraining of the barrier. Reduction of the pressure allows the actuation device to move to a disengaged position wherein the bias moves the latch to the unlatching position in which the barrier is not constrained.

18 Claims, 14 Drawing Sheets

(56) References Cited

U.S. PATENT DOCUMENTS

| | | | | |
|---|---|---|---|---|
| 4,021,066 | A * | 5/1977 | McShane | 292/144 |
| 4,647,089 | A | 3/1987 | Zangrando | |
| 5,044,678 | A * | 9/1991 | Detweiler | 292/144 |
| 5,052,276 | A | 10/1991 | Halsey | |
| 6,032,416 | A | 3/2000 | Springer et al. | |
| 6,168,113 | B1 | 1/2001 | Hann et al. | |
| 6,416,092 | B1 * | 7/2002 | Rathmann | 292/336.3 |
| 6,746,073 | B2 | 6/2004 | Heller et al. | |
| 7,360,803 | B2 | 4/2008 | Parent et al. | |

FOREIGN PATENT DOCUMENTS

| | | |
|---|---|---|
| EP | 152277 | 8/1985 |
| FR | 568610 | 3/1924 |
| FR | 596830 | 11/1925 |
| GB | 14662 | 12/1914 |
| GB | 2237839 | 5/1991 |
| JP | 2003221957 | 8/2003 |
| WO | WO 00/73608 | 12/2000 |
| WO | WO 01/81693 | 11/2001 |

OTHER PUBLICATIONS

Supplementary European Search Report mailed Feb. 1, 2008 for PCT/AU2004000617 (EP 04 73 2249).

European Examination Report mailed Jun. 6, 2008 for EP 04 73 2249.

Response to European Examination Report filed Dec. 3, 2008 for EP 04 73 2249.

European Examination Report mailed Jun. 15, 2009 for EP 04 73 2249.

Response to European Examination Report filed Oct. 23, 2009 for EP 04 73 2249.

* cited by examiner

BARRIER RELEASE MECHANISM

CROSS-REFERENCE TO RELATED APPLICATIONS

This application is a continuation application that claims priority benefit to co-pending U.S. Ser. No. 10/556,701, filed Nov. 10, 2005, which is a 371 Application of International Patent Application No. PCT/AU2004/000617, filed May 12, 2004, which claims priority to Australian Application No. 2003902273, filed May 12, 2003.

FIELD OF THE INVENTION

The invention relates to barriers and, in particular, to a barrier release mechanism.

The invention will now be described with reference to access barriers including barred or grilled barriers, doors, windows, barred door or window frames, sporting arena fencing, sliding-type or linear action doors and rotating doors and will be described hereinafter with reference to this application. However, it will be appreciated that the invention is not limited to these particular fields of use.

BACKGROUND OF THE INVENTION

It is commonly known to put barred metal barriers around windows and doors to deter unauthorized entry therethrough and/or provide protection against projectiles. The metal barriers for doors or windows may be fixed in place or hinged with one or more locks securing one or more marginal edges to a barrier support frame or building structure.

In the case of barred or grilled metal window barriers, they are often simply bolted to a surrounding window frame or structure with the bolt heads modified or welded to the barrier support frame to prevent barrier removal and a potential access point.

Although these barred metal door and window frames provide excellent security from intruders they also provide a similar barrier to those within trying to exit in emergency situations, and others desiring emergency entry from outside in the situations.

In the case of barred or grilled metal window barriers which are not hinged, no emergency entry or egress is possible and those barred or grilled metal door or window barriers which are hinged are generally deadlocked or padlocked which does not allow quick entry or egress in the case of an emergency without ready access to both the door and the door lock key or the like.

Many premises which are susceptible to unauthorized entry through doors or windows, such as schools, police stations and the like, place barred or grilled metal barrier around windows such that once installed they need to be cut away or have a weld or rounded bolt head cut away in order to remove them. As noted above, these barred metal barriers provide excellent security, however, every time a window is broken it must be replaced from the outside requiring the barred metal barriers to be cut away from a window.

In the case of schools for example window breakages are very common and the need to fully remove a barred metal window frame that is fixed there around is significantly more expensive than simply replacing the window. Unfortunately, most windows are designed to be replaced from the outside necessitating the expensive removal and replacement of barred metal window frames when windows are broken.

This is also the case in conventional door-type barriers which include a locking device such as a dead latching lock or other keyed lock in which a latch engages with a strike plate disposed in a predetermined location around the doorframe. In some cases, the strike plate includes a hinged trailing edge which can be electromechanically biased towards an engaged position to retain a door latch in the closed position and to rotate freely against the force of the latch when the electromechanical lock is actuated thereby allowing the door latch to move the trailing edge of the strike plate so as to open the door. It is noted that proximity readers or keys are most often used to engage or disengage the door latch from the strike plate. In the case of standard door deadlocks, a key is normally required.

These locks provide a particularly useful security barrier, however, as with hinged barred window frames it is often difficult to egress through such deadlocked doors in an emergency situation, particularly for the elderly or in cases where people are disorientated. That is, without the key or proximity card and clear conditions to the door, the door can be very difficult to open.

Indeed, all doors and windows which are closed for security reasons include an electromechanical or mechanical lock, or are completely fixed shut. In these cases, it is extremely difficult to enter or egress in emergency situations. For example, recent nightclub fires in Chicago, Ill. killed many people due to many doors and windows being permanently fixed shut or completely locked shut. With some of the doors, nightclub staff having appropriate keys were unable to move to a door and unlock it.

It is also the case that linear motion doors such as train doors are biased and locked in a closed position when power is removed from a train. In these cases, it is only possible to access a train carriage by smashing a window or prying open doors. The latter method can be very difficult, even to emergency services workers, as the doors are designed to remain secure against unauthorised entry.

In other locations where barriers are found, such as high security fencing around the boundary of sporting arenas, many people have died due to crowd surges and people being crushed against the fences. The fences can be removed, however an arena official with an appropriate key to a lock needs to be on hand. Past events have shown that these fences and their quick removal are grossly inadequate.

OBJECT OF THE INVENTION

It is an object of the present invention to provide a barrier release mechanism which will overcome or substantially ameliorate at least some of the deficiencies of the prior art, or to provide a useful alternative.

SUMMARY OF THE INVENTION

According to a first aspect of the invention there is provided a barrier release mechanism for a barrier including at least one barrier latch, the system including:

a latch actuation device disposed adjacent the barrier and coupled to the barrier latch, the latch actuation device being movable between an engaged position in which the latch actuation device causes a barrier latch to be engaged thereby latching the barrier and a disengaged position in which the latch actuation device causes the barrier latch to disengage thereby allowing the barrier to be moved, the latch actuation device being resiliently biased into the disengaged position;

a source of fluid pressure in fluid communication with the latch actuation device; and a pressure control valve disposed fluidly intermediate the latch actuation device and the source of fluid pressure, the pressure control valve configured for controlling pressure applied to the latch actuation device;

wherein upon the application of a predetermined fluid pressure on the latch actuation device causes it to move into the engaged position and a predetermined reduction of fluid pressure to the latch actuation device causes it to move to the disengaged position.

In preferred embodiments, the pressure control valve is integral with the latch actuation device. More preferably, the fluid is hydraulic or pneumatic and the source of fluid pressure is a compressed fluid cylinder, fluid compressor, fluid ram, reticulated fluid supply, or pressurised fluid supply.

Preferably, the latch actuation device is a is a bladder, cylinder or piston, diaphragm or pressure chamber.

In preferred embodiments, the latch actuation device is directly coupled to the barrier latch. More preferably, the latch actuation device is coupled to the barrier latch via a control arm.

Preferably, the barrier latch is a door locking pin. In alternative preferred embodiments, the barrier latch is a movable or collapsible barrier locking strike plate mounting.

Preferably, the pressure control valve includes an outlet for de-pressuring the latch actuation device causing the latch to move to the disengaged position and the pressure control valve outlet is actuatable to de-pressurise the latch actuation device in response to an alarm or other predetermined condition, or in response to a manually applied force.

In preferred embodiments, the barrier is hingedly mounted along one marginal edge to a barrier support frame or structure and the barrier latch is disposed adjacent an opposite edge of the barrier support frame or structure. More preferably, the barrier release mechanism includes a plurality of latch actuation devices disposed adjacent two or more barrier marginal edges wherein the barrier is fixedly mounted within a barrier support frame or structure by the barrier latch when the latch actuation device is in the engaged position.

Preferably, the barrier latch and the latch actuation device are integrated into the barrier support frame or structure, or the barrier latch and the latch actuation device are integrated into the barrier.

In preferred embodiments, the barrier is a door, or a barred frame or grilled door having a door latch configured for engagement with a door frame or support structure mounted strike plate to retain the door in a latched position, the latch actuation device when in the engaged position retains the door frame strike plate so as to retain the door latch and the door in latched position, and the fluid actuated latch actuation device in the disengaged position disengages the strike plate from the door frame wherein the strike plate is free to move under force from the door latch allowing the door to open.

Preferably, the strike plate rotatably movably mounted and the barrier release mechanism is integrated into the door frame strike plate.

In preferred embodiments, the barrier is a linearly movably mounted door driven by a linear actuator and the latch actuation device is configured to disengage the linear actuator from the door when moved to the disengaged position and to engage the linear actuator to the door when the latch actuation device in moved to the engaged position. More preferably, the latch actuation device engages and disengages the door linear actuator via a clutch.

In other embodiments of the invention, the barrier is a rotating door driven by a rotational actuator, the latch actuation device being configured to disengage the rotational actuator from the rotating door when the latch actuation device is moved to the disengaged position to allow the rotating door to rotate independently of the rotational actuator and to engage the rotational actuator to the rotating door when the latch actuation device in moved to the engaged position to allow the rotating door to be rotated by the rotational actuator.

Also preferably, there is provided a barrier release system including a plurality of barrier release mechanisms according to any one of the preceding claims, each barrier release system being configured for releasing a respective barrier.

In preferred embodiments, the barrier is an emergency exit door having one or more multipoint door latches wherein the latch actuation device is coupled to one of the multipoint door latches wherein application of a predetermined pressure on the latch actuation device causes the multipoint latches to engage with one or more corresponding door latch strike plates. More preferably, the barrier release mechanism includes a manual override coupled to the latch actuation device or one or more of the multipoint latches wherein actuation of the manual override causes the latch actuation device or multipoint latches to disengage whilst maintaining fluid pressure to the latch actuation device.

According to a second aspect of the invention there is provided a removable barrier strike plate housing configured for retainingly engaging a barrier latch, the removable barrier strike plate housing configured for mounting in a barrier frame adjacent the barrier latch, the strike plate housing being movable between an engaged position in which the a latch actuation device retains the barrier strike plate housing in the barrier frame and a disengaged position in which the latch actuation device is spaced apart from the barrier strike plate housing to allow the barrier strike plate to move and disengage from the barrier latch, the latch actuation device being resiliently biased into the disengaged position and coupled to a fluid pressure control valve in communication with a source of fluid pressure, the pressure control valve coupled to the latch actuation device wherein application of a predetermined fluid pressure on the latch actuation device causes it to move into the engaged position and a predetermined reduction of fluid pressure to the latch actuation device causes the latch to move to the disengaged position.

Thus, there is provided a barrier release system which the barrier or its retaining barrier lock-latch strike plate can be readily unlatched in case of an emergency and which will still provide a high level of security.

BRIEF DESCRIPTION OF THE DRAWINGS

Preferred embodiments of the invention will now be described, by way of example only, with reference to the accompanying drawings in which.

DESCRIPTION OF THE PREFERRED EMBODIMENTS

Figure 1:
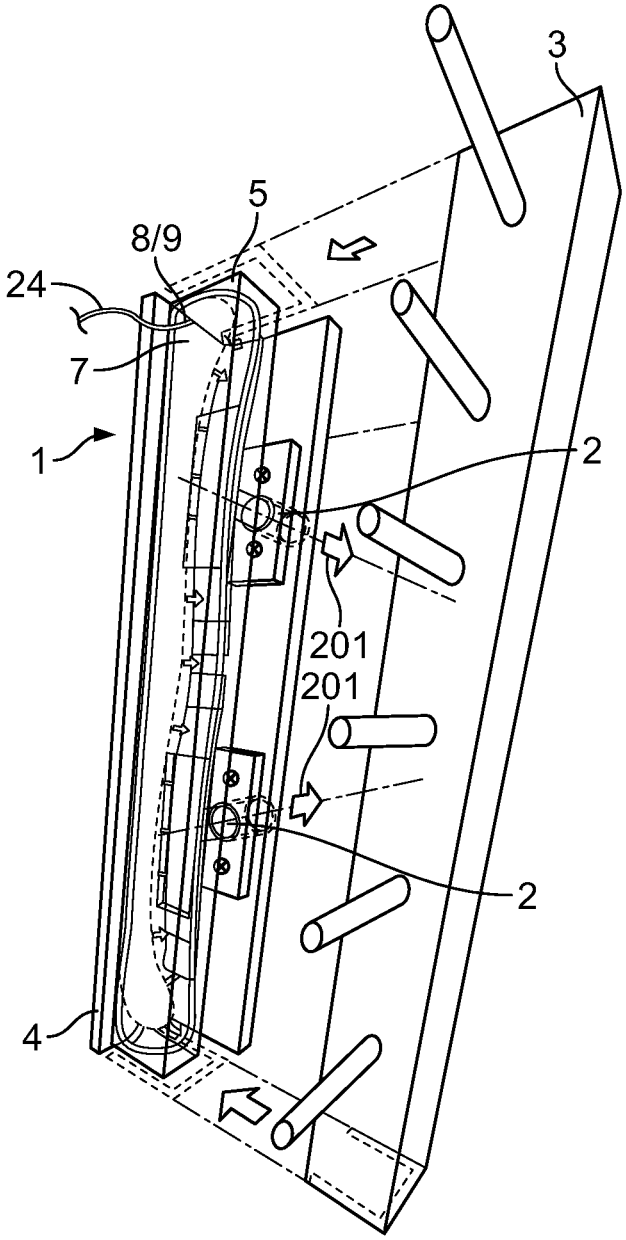
FIG. 1 is a perspective view of a barrier release mechanism in an engaged position according to a first embodiment.
Figure 2:
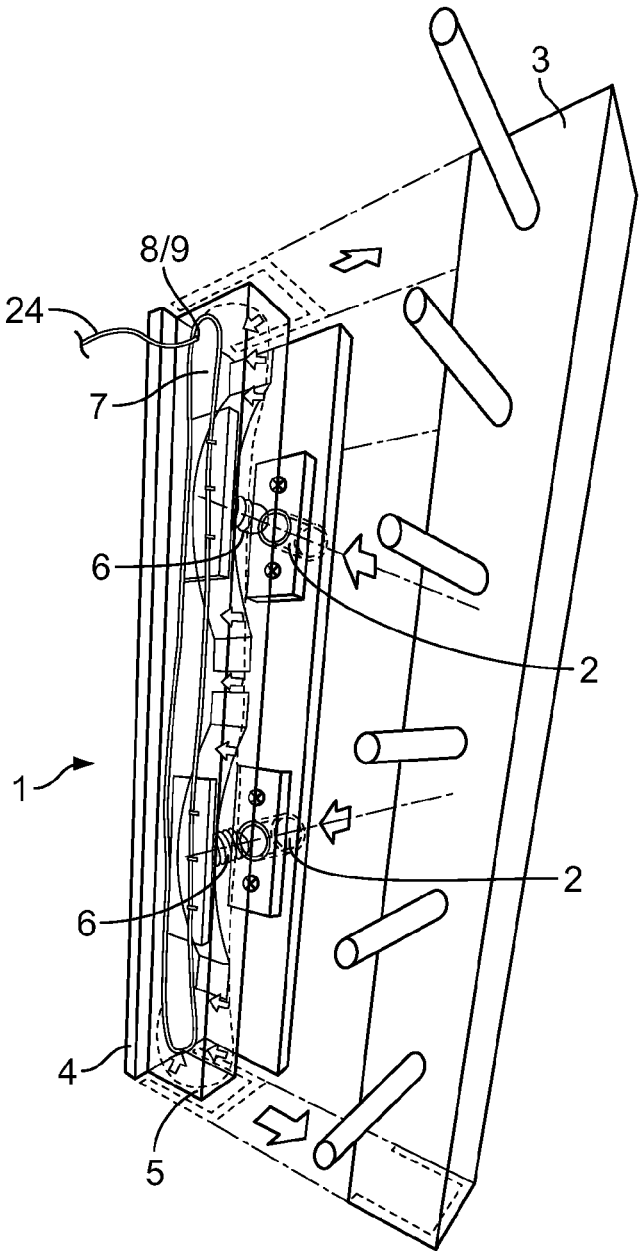
FIG. 2 is a perspective view of the mechanism of FIG. 1 in a disengaged position.
Figure 3:
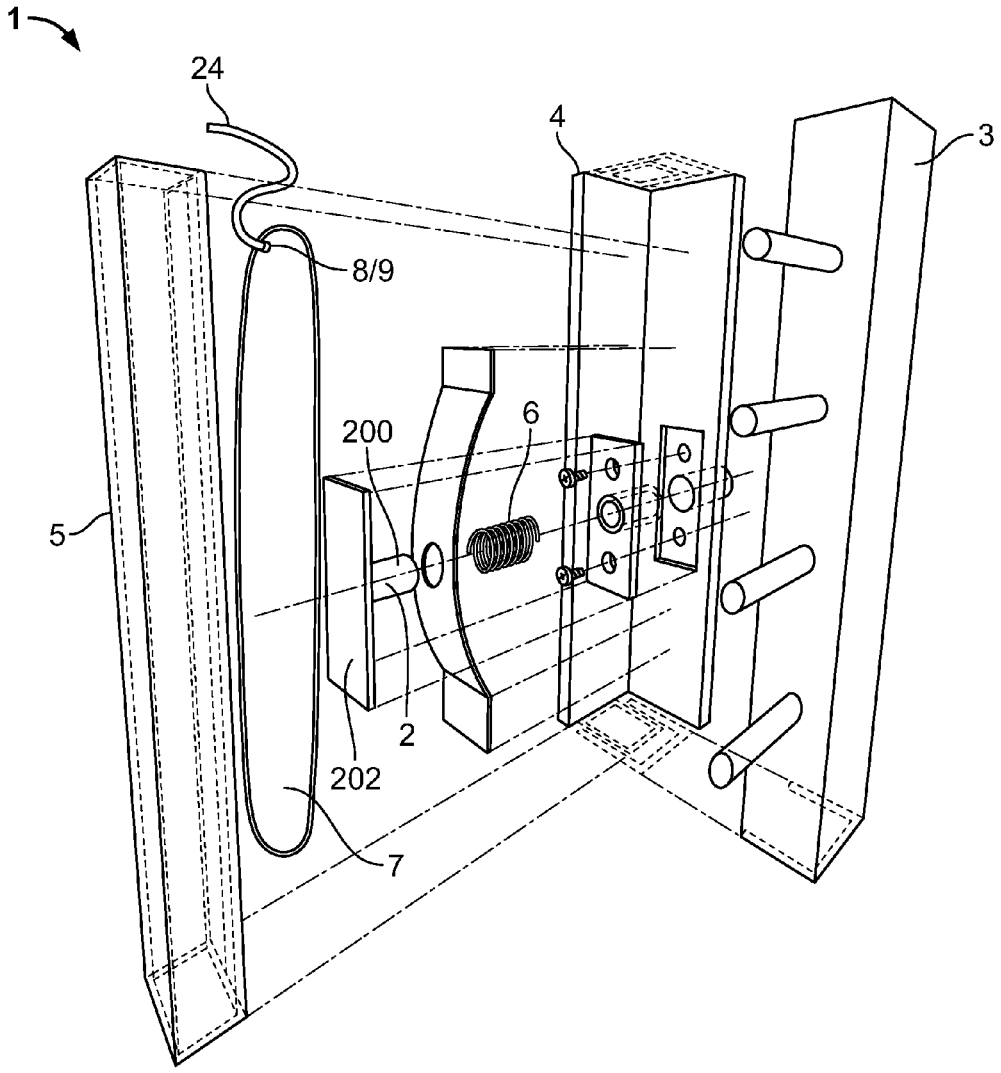
FIG. 3 is an exploded view of the mechanism of FIGS. 1 and 2.

Referring to FIGS. 1 to 3, and where like reference numerals denote like parts, there is shown a barrier release mechanism 1.

The barrier release mechanism 1 includes a plurality of latches 2 to disposed adjacent a barrier 3. The barrier 3 is hingedly mounted (not illustrated) to a barrier support frame 4. Barrier support frame 4 can include a structure adjacent to which the barrier is disposed.

The latch 2 is movable in a direction 201 between an engaged position, as best shown in FIG. 1 so as to retain the barrier 3 by engagement between engagement portions 200 of the latches 2 and the support frame 4, and is movable from the engaged position to a disengaged position.

The barrier release mechanism 1 is contained in a housing 5 which is integrated into the barrier support frame 4. The latches 2 are resiliently biased into the disengaged position by means of springs 6 disposed intermediate the latches 2 and the barrier support frame 4.

Again as best shown in FIG. 1, the barrier release mechanism 1 includes a latch actuation device 7 in the form of an activation bladder which is disposed adjacent the latches 2. However, it is noted that the latch actuation device 7 can be or include a piston, cylinder, diaphragm, or pressure chamber.

Application of a predetermined fluid pressure to the latch actuation device 7 causes it to abut actuation surfaces 202 of the latches 2 to move the latches 2 into the engaged position and a loss of pressure from the latch actuation device 7 causes the latches 2 to move to the disengaged position so as to disengage the latches 2 under the bias of the springs 6.

It is noted that a diaphragm, cylinder or piston, a compressed fluid cylinder, fluid compressor, fluid ram, reticulated fluid supply, or pressurised fluid supply, or other pressure chamber may be employed as a discrete source of fluid pressure. Further, the fluid can be hydraulic or pneumatic.

In other embodiments (not illustrated in FIG. 1) a source of fluid pressure is disposed remotely from the latch actuation device 7 and in fluid communication with a latch actuation device inlet 8 (not illustrated in FIG. 1) to provide pressure thereto.

As shown generally in FIGS. 1 to 3, the latch actuation device inlet 8 is configured for engagement with a pressure control valve (not illustrated) for selectively providing pressure to the latch actuation device 7 so as to cause engagement of the latches 2 with the barrier 3. As also noted above, the source of fluid pressure can include, for example, hand or motor driven pumps, pressurised fluid cylinders or pumps, or a reticulated water supply.

Similarly, the latch actuation device 7 further includes an outlet 9 for depressurising the latch actuation device 7 so as to allow the latch 2 to move to the disengaged position under the bias of the springs 6. The inlet 8 is also configured for use as the outlet 9. In other embodiments (not illustrated) a separate outlet 9 is employed.

The outlet 9 can be actuated to depressurise the fluid pressure control device 7 in response to an alarm or other predetermined condition. Although not illustrated, a solenoid valve is connected to the outlet 9 and, when actuated in response to a fire alarm, can cause the depressuring of the latch actuation device 7 to allow the latches 2 to become disengaged under the bias of the springs 6 and the barrier 3 movable on its hinge. Similarly, the latch actuation device 7 can be depressurised in response to a signal from a remotely disposed smoke or heat detector or the like. Likewise, a manual override depressurisation actuator (not illustrated) can also be used in combination.

It is noted that although the barrier 3 shown in FIG. 1 is hingedly mounted along one marginal edge, the hinges may be removed and replaced with a second barrier release mechanism 1 disposed on another edge of the barrier wherein depressuring the latch actuation device 7 (or reducing the pressure thereto by a predetermined amount) in each mechanism 1 results in the barrier being fully disengaged from the barrier support frame or structure 4, as best shown in FIG. 2.

Figure 4:
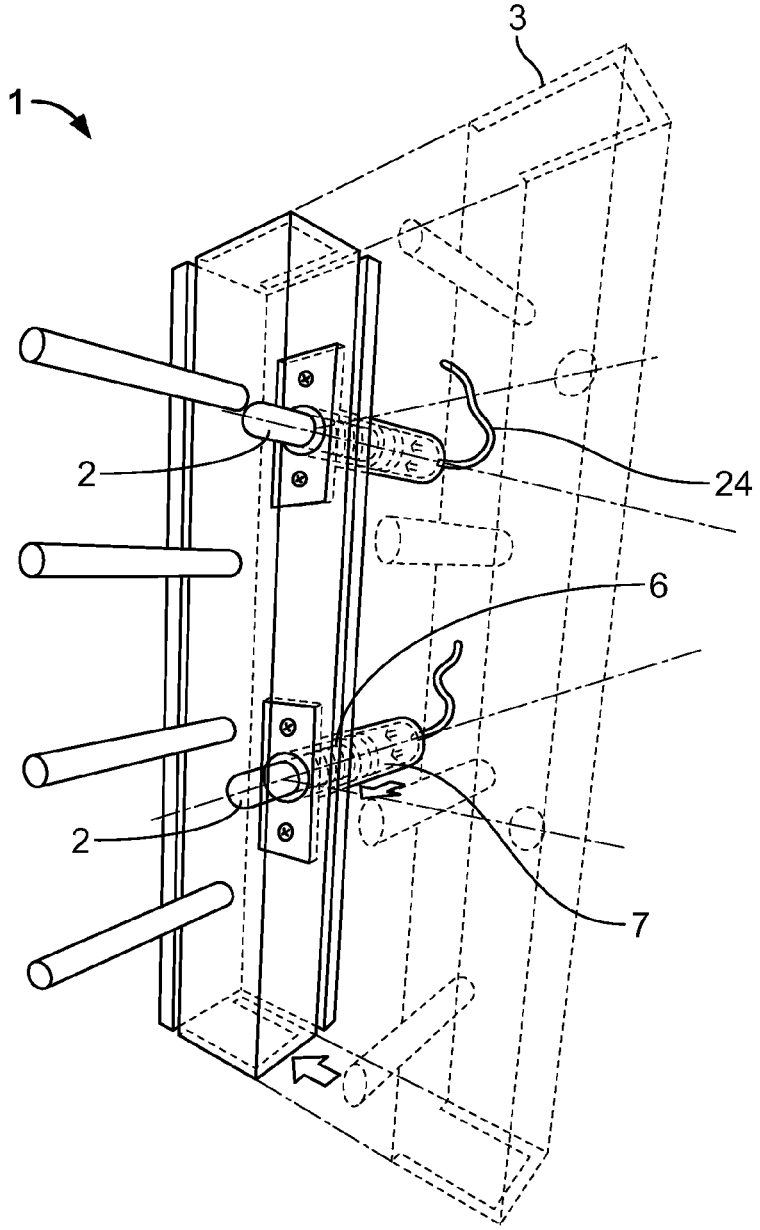
FIG. 4 is a comparative example of a barrier release mechanism in an engaged position.
Figure 5:
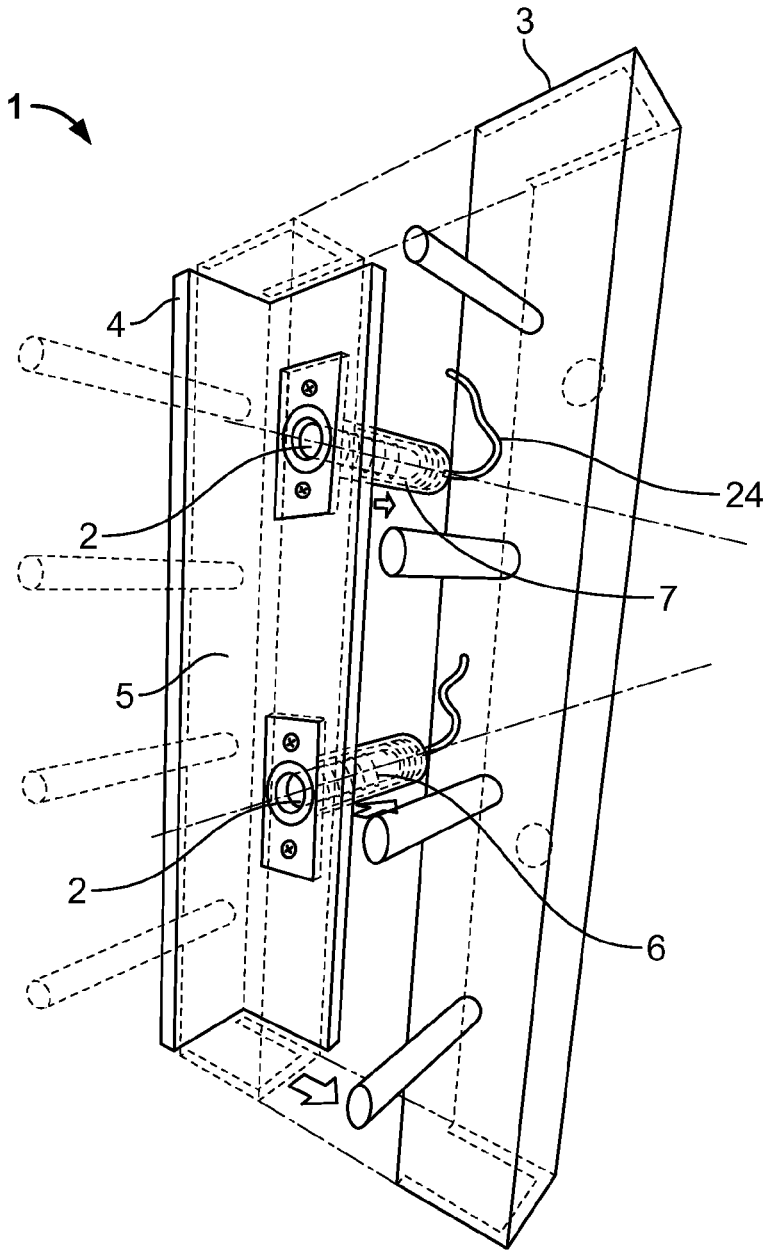
FIG. 5 is a perspective view of the mechanism of FIG. 4 in a disengaged position.
Figure 6:
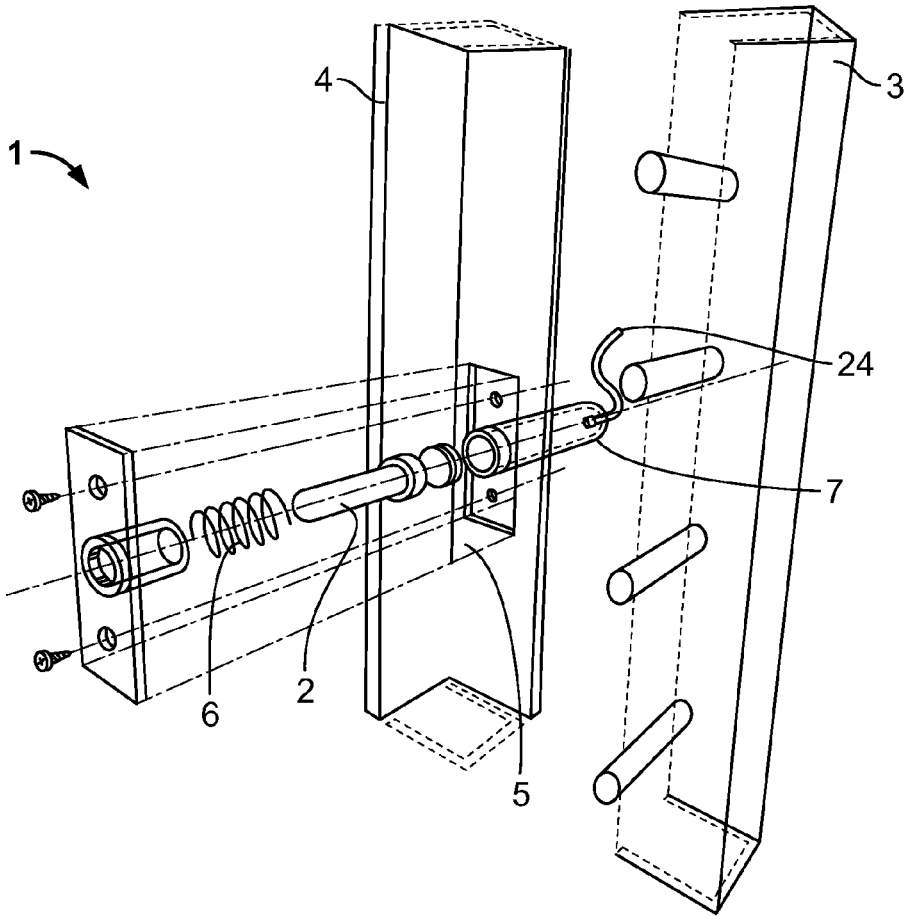
FIG. 6 is an exploded view of the mechanism of FIGS. 4 and 5.

Turning to FIGS. 4 to 6, there is shown a comparative example of a barrier release mechanism 1, again where like numerals refer to like parts. In this example, pressure is applied directly to cylinders 7 by the fluid pressure source via a pressure tube 24 to cause the latch actuation device 7 to move into the engaged position and thereby engage the latches 2 to the barrier support frame 4.

Although not illustrated, the pressure tube 24 is fluidly connected to the pressure reservoir with a pressure control valve (not illustrated) disposed intermediate. In this way, the valve can be used to control the application of pressure to the latch actuation device cylinder 7.

Figure 7:
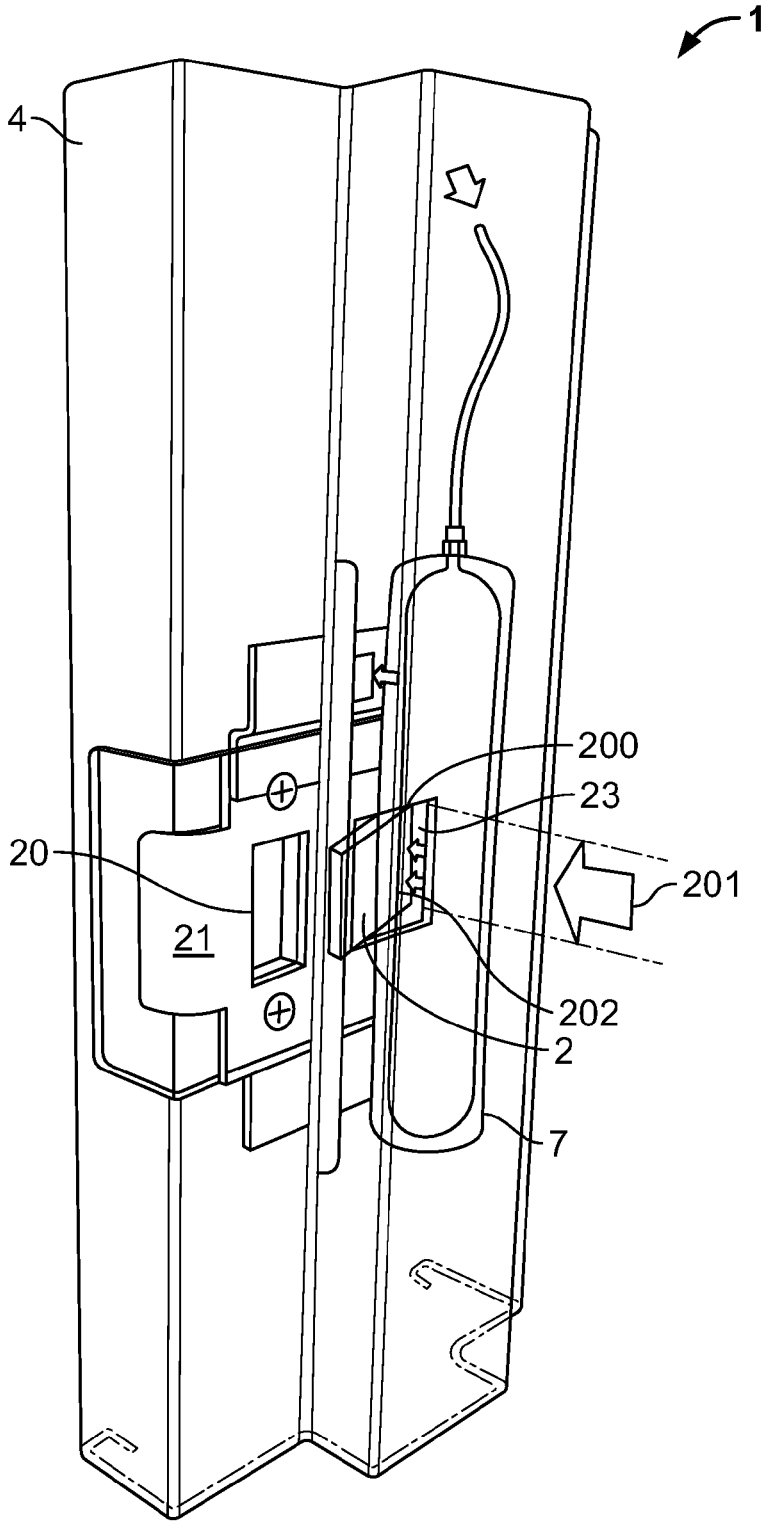
FIG. 7 is a perspective view of a barrier release mechanism in an engaged position according to another embodiment.
Figure 8:
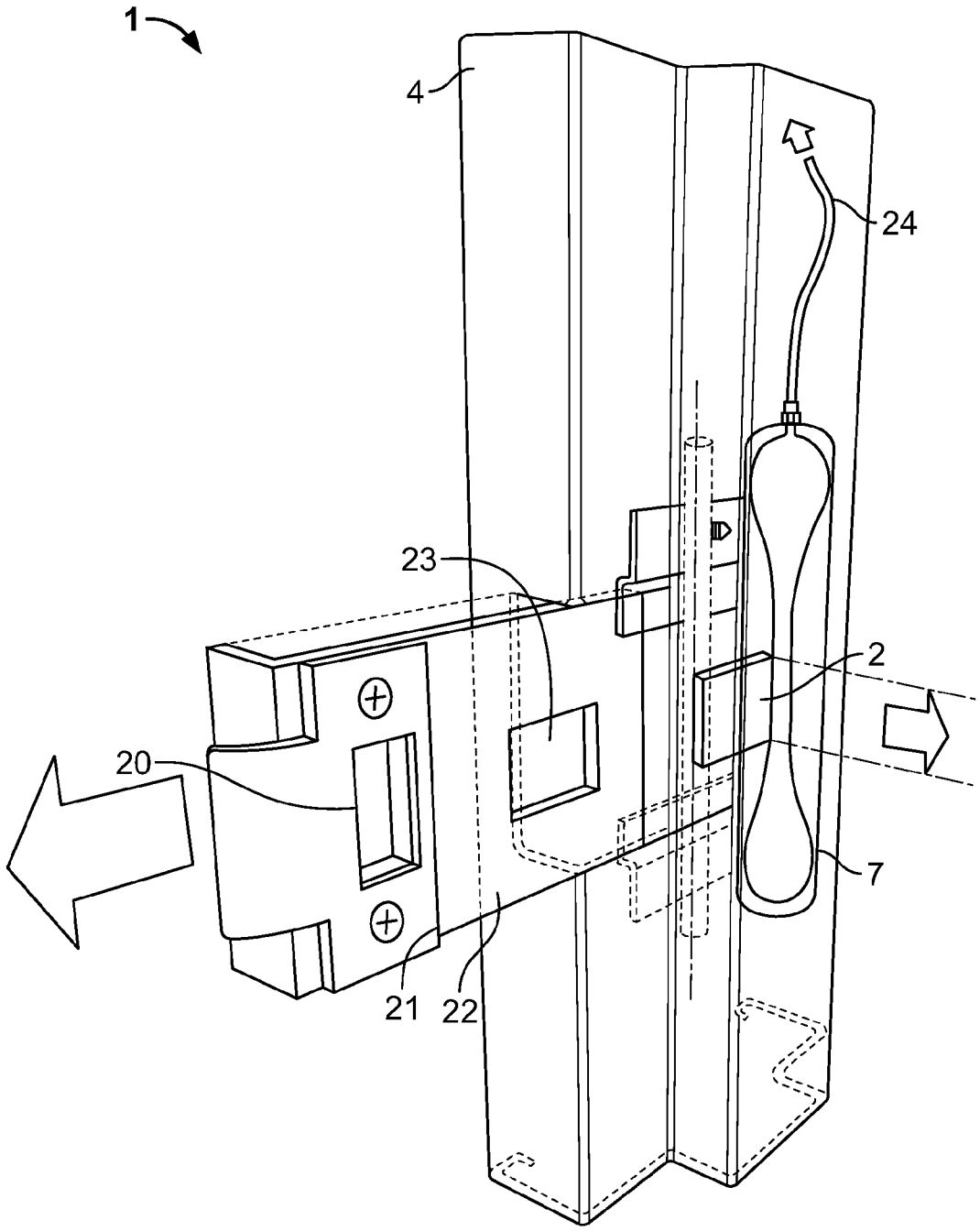
FIG. 8 is a perspective view of the mechanism of FIG. 7 in a disengaged position.
Figure 9:
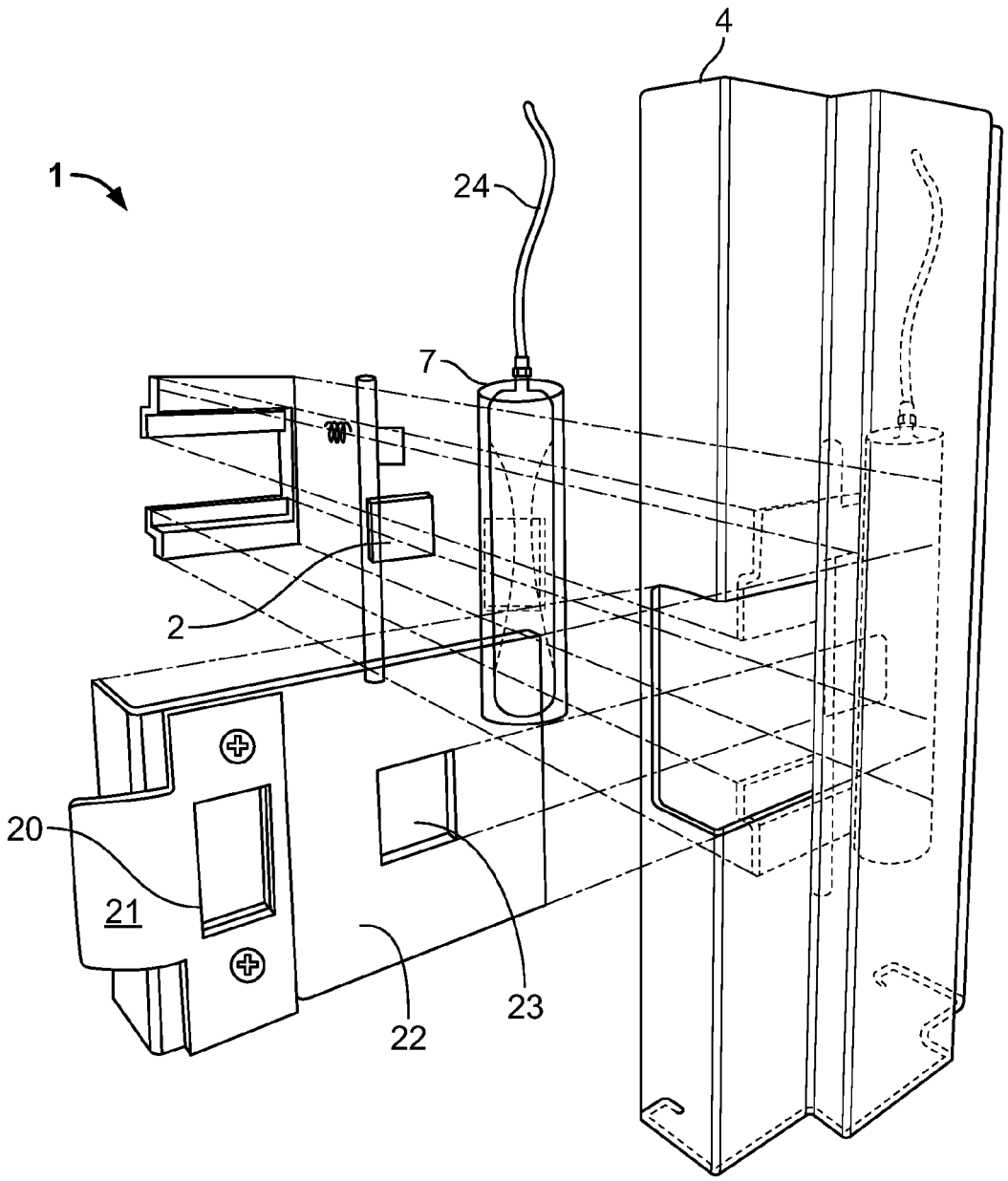
FIG. 9 is an exploded view of the mechanism of FIGS. 7 and 8.

Turning to FIGS. 7 to 9, again where like numerals refer to like parts, there is shown a barrier release mechanism 1 wherein the barrier 3 is in the form of a door or barred metal door barrier (not illustrated) having a lock latch configured for engagement with a front edge 20 of a strike plate 21 for retaining the door in a closed position. The mechanism 1 includes latch 2 disposed adjacent a strike plate apparatus 22 including the strike plate 21 for retaining the strike plate apparatus 22.

The latch 2 is rotatably movable between an engaged position in which it retains the strike plate apparatus 22 at aperture 23 and a disengaged position in which the latch 2 is spaced apart from the aperture 23 allowing the strike plate apparatus 22 to move from the doorframe or supporting structure. The latch actuation device 7 is again in the form of an actuation bladder and the latch 2 is rotatably mounted adjacent the actuation bladder 7. The application of a predetermined pressure to the latch actuation device 7 causes the latch 2 to move into the engaged position and depressurising the actuation bladder allows the latch 2 to move under bias to the disengaged position.

The latch actuation device bladder 7 is in fluid communication with a pressure tube 24 which is in fluid communication with a source of fluid pressure for providing pressure to the latch actuation device bladder 7. The latch actuation device 7 is also in communication with a pressure control valve (not illustrated) for depressurising the actuation bladder and disengaging the latch 2 from the aperture 23, releasing the strike plate apparatus 22.

That is, the strike plate apparatus 22 is free to move under the force of the door lock-latch (not illustrated) engaging front edge 20 of the strike plate 21 so as to move the entire strike plate apparatus 22 from the door frame thereby allowing the door to open. As is clearly seen, the barrier release mechanism 1 is integrated into the door frame or support structure 4.

The latch actuation device bladder 7 can be remotely depressurised through the pressure control valve (not illustrated) that is disposed fluidly intermediate the latch actuation device bladder 7 pressure tube 24 in response to an alarm such as a smoke or heat sensor, a general alarm or other predetermined condition.

Turning to FIGS. 10 and 11, again where like numerals refer to like parts, there is shown another embodiment of a barrier release mechanism 1. The strike plate apparatus 22 is slideably mounted within the doorframe so that a linearly movable latch 2 mounted in the strike plate apparatus 22 retains it to the door frame 4 such that when the latch 2 is moved from the engaged position to the disehgaged position, the strike plate apparatus 22 is slideably removable under the force of a door lock-latch from a strike plate housing 25 mounted within the doorframe. That is, the latch 2 engages with the strike plate via the strike plate housing 25. Although not shown, the latch 2 is resiliently biased into the disengaged position.

The latch actuation device 7 in the form of the actuation bladder is disposed within apparatus 22 and connected to the fluid pressure source 24. As noted in embodiments above, the source of fluid pressure is applied via a pressure control valve to pressurise or depressurise the latch actuation device 7 to thereby cause the latch 2 to move from the engaged position to the disengaged position or vice versa.

Figure 10:
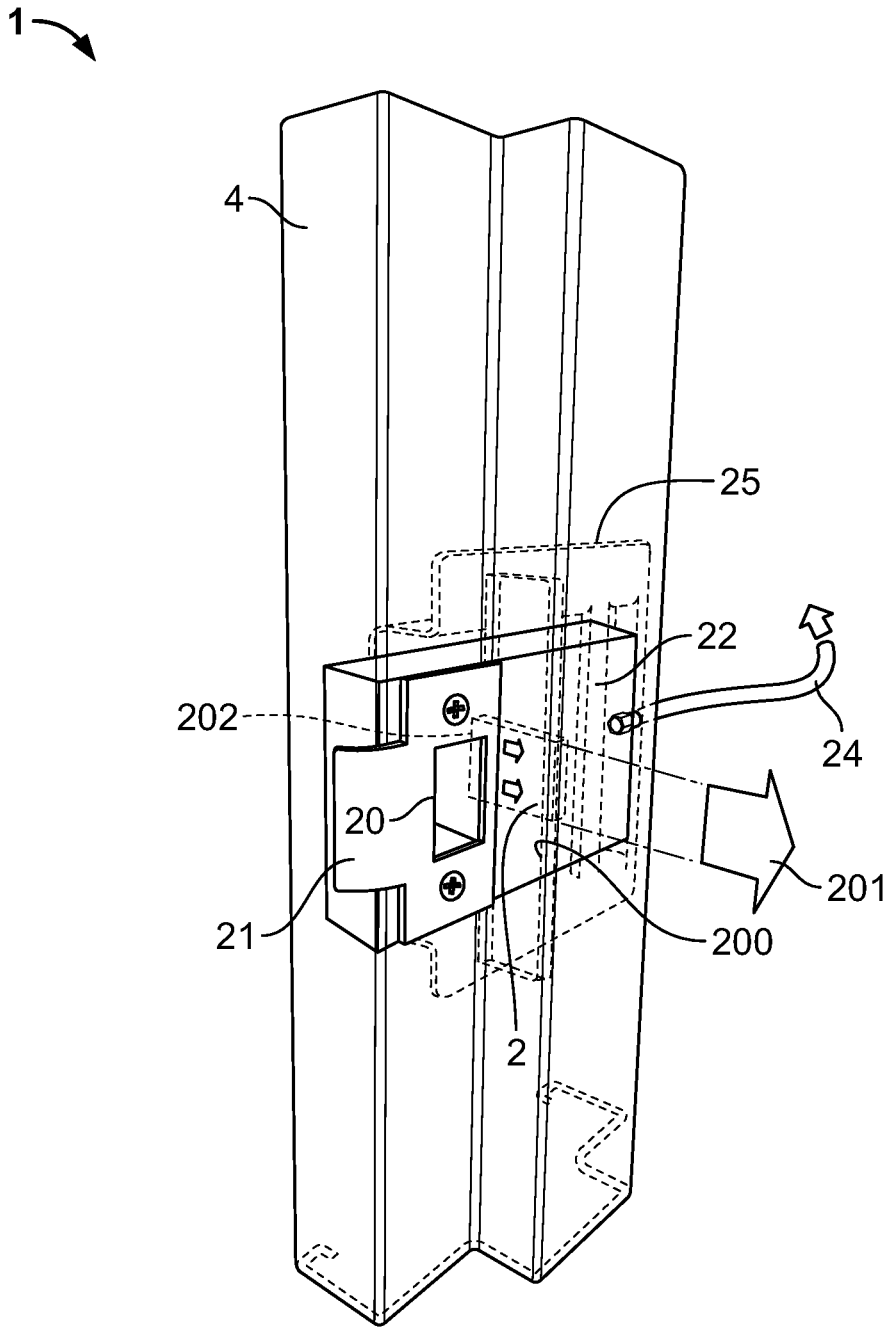
FIG. 10 is a perspective view of a barrier release mechanism in an engaged position according to another embodiment.
Figure 11:
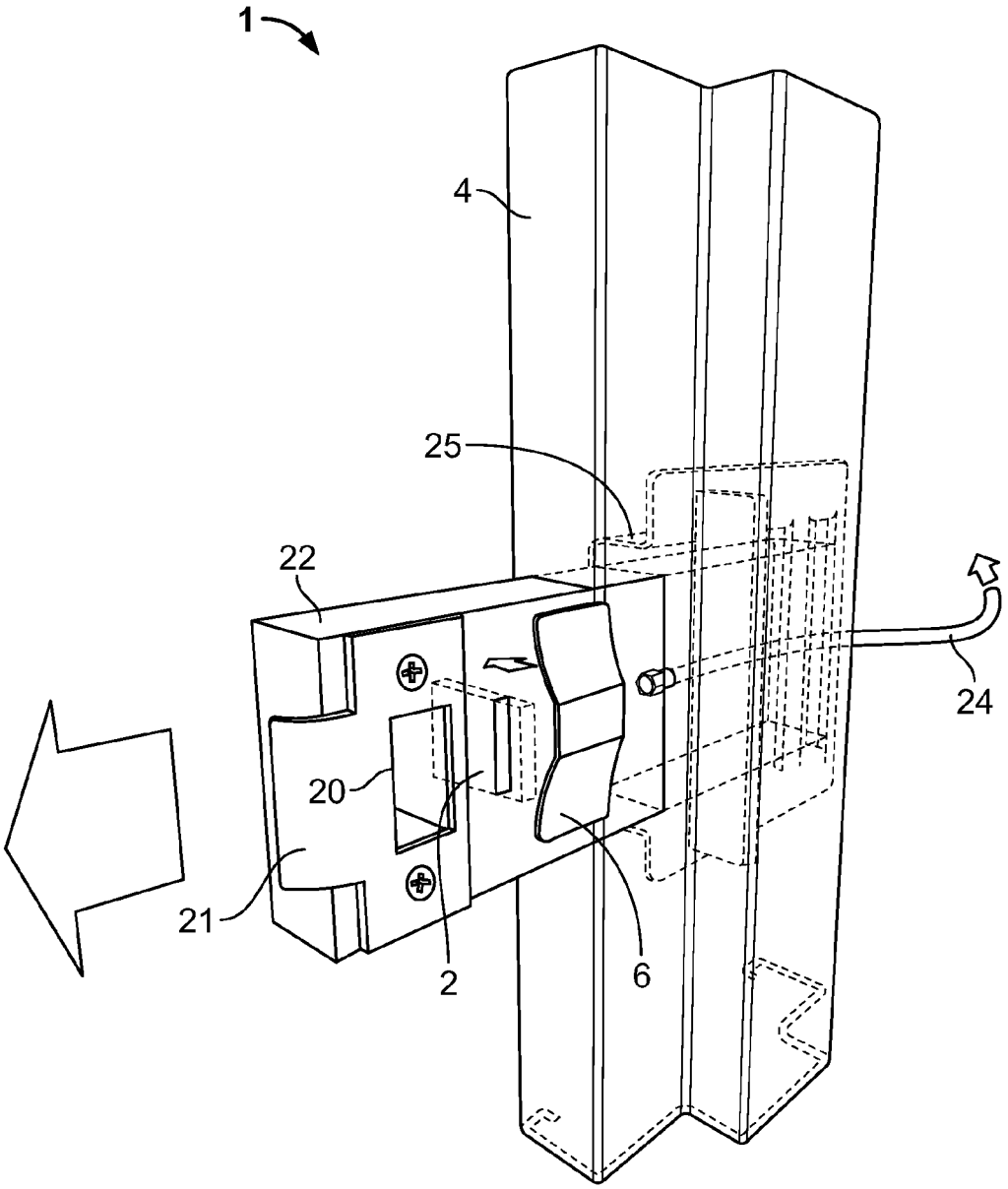
FIG. 11 is a perspective view of the mechanism of FIG. 10 in a disengaged position.
Figure 12:
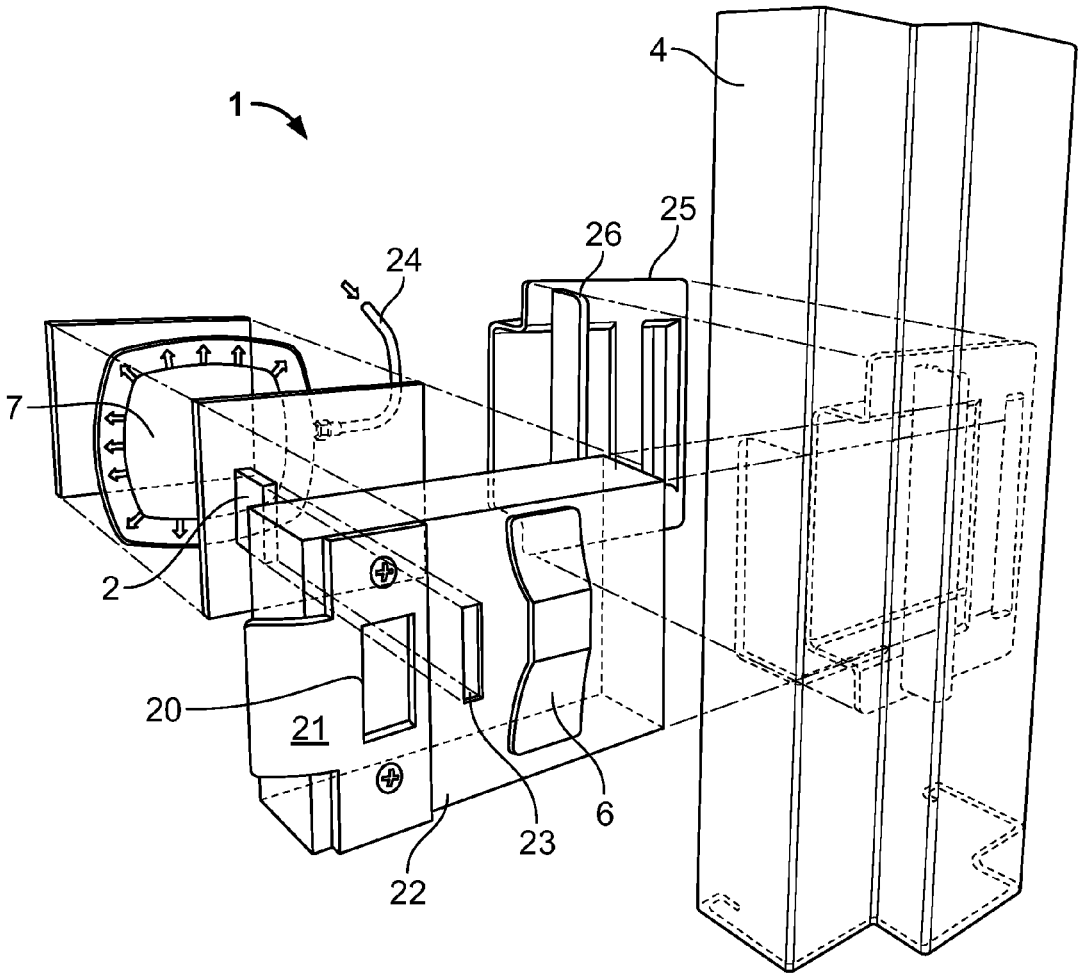
FIG. 12 is an exploded perspective view of a barrier release mechanism in an engaged position according to another embodiment.

Referring now to FIG. 12, there is shown a barrier release mechanism 1 being similar to the embodiment shown in FIGS. 10 and 11. In this embodiment, the latch actuation device is a bladder 7 coupled to the latch 2 directly where pressurisation of the bladder 7 causes the latch 2 to move linearly against a resilient bias and engage a flange 26 in the strike plate housing 25 to retain the strike plate apparatus 22 within a barrier support frame 4.

It is noted that engagement of the latch 2 with a barrier lock-latch (not illustrated) may occur directly, for example as shown in FIG. 1, or indirectly as shown in FIG. 2 or 3, where in these latter embodiments the latch 2 engages a door strike plate to retain the barrier. Any conventional engagement can be used between the barrier 3 and latch 2.

In FIGS. 13 to 16, again where like numerals refer to like parts, there is shown a schematic view of an emergency door barrier 3 hingedly mounted (not illustrated) along one side marginal edge to a door frame or supporting structure 4. The emergency barrier in the embodiment of FIGS. 13 and 14 has mounted to it a barrier latch 170 being linearly movable between an open position (shown in the FIGS.) where the barrier is free to move and closed position where the barrier 3 is retained by latch 170 in aperture 23.

The barrier latch 170 is resiliently biased into the open position by a spring 6. The barrier latch 170 is configured to be received by a strike plate or aperture when in the closed position. A barrier release mechanism 1 is disposed adjacent the upper marginal edge of the barrier 3 to the barrier frame 4.

The latch actuation device 7 is coupled to a primary latch 171 such that when pressure is applied to the latch actuation device via pressure line 24, the primary latch 171 is moved linearly downward and causes the barrier latch 170 to be moved into the closed position. The latch 170 is then retained by aperture 23 and by an aperture 27 formed from a barrier latch bracket 29. It can be seen that the primary latch 171 and barrier latch 170 form a multipoint (two in this embodiment) latchable barrier 4. When the pressure applied to the latch actuation device falls below a predetermined amount, the primary latch 171 moves away from the barrier latch 170. This results in the barrier latch 170 being allowing to move the open position and the primary latch to move clear of the upper marginal edge of barrier 3 to thereby allow the barrier 3 to be moved.

Figure 13:
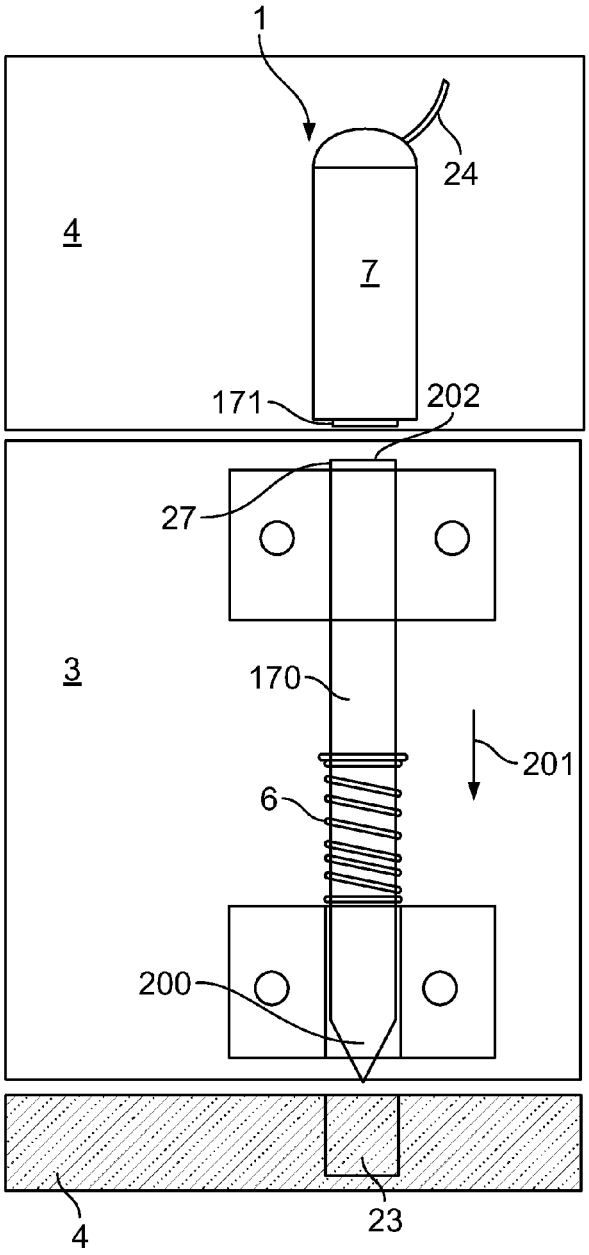
FIG. 13 is a front view of a barrier release mechanism in a disengaged position according to another embodiment.
Figure 14:
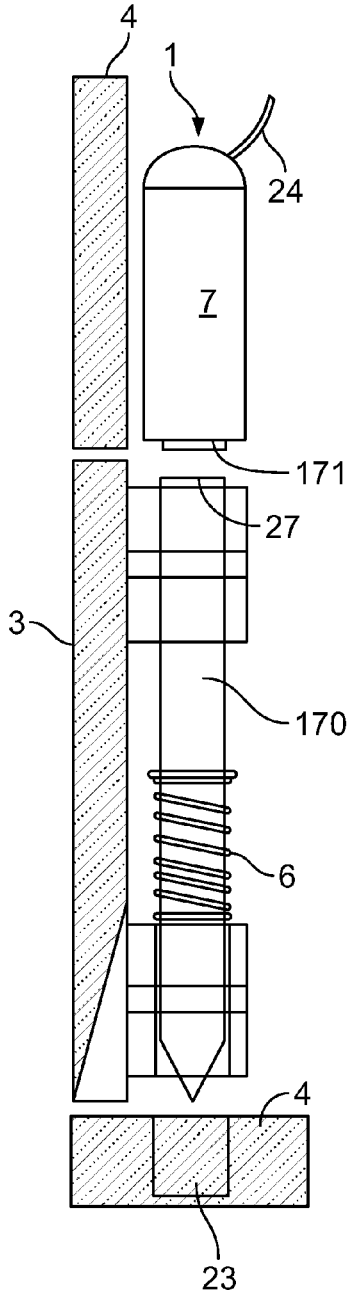
FIG. 14 is a side view of the mechanism of FIG. 13.
Figure 15:
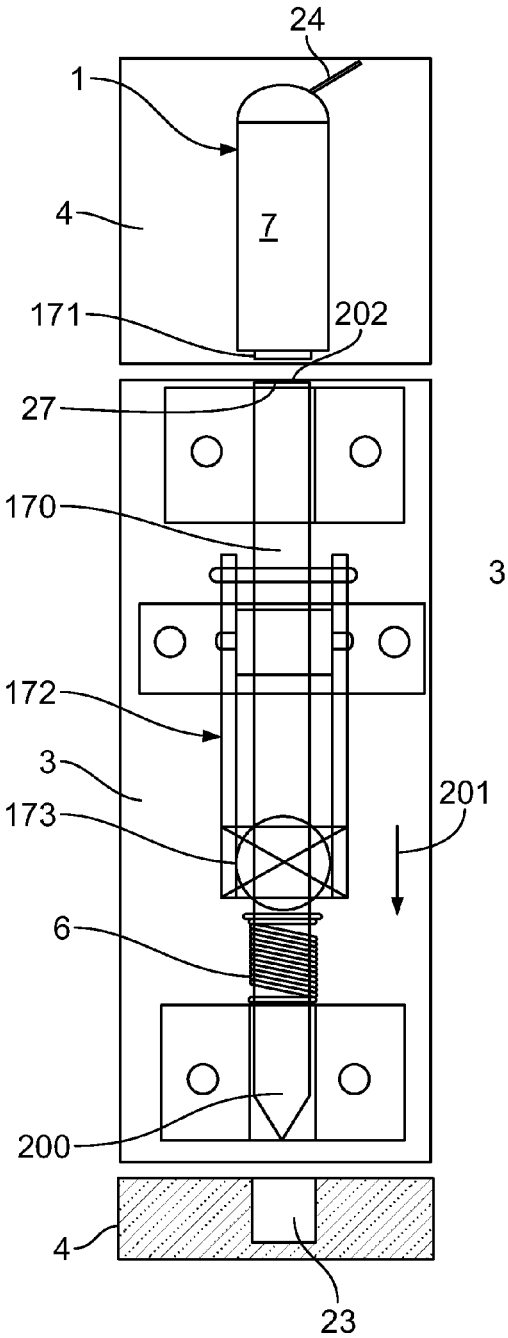
FIG. 15 is a front view of a barrier release mechanism in an engaged position according to another embodiment.
Figure 16:
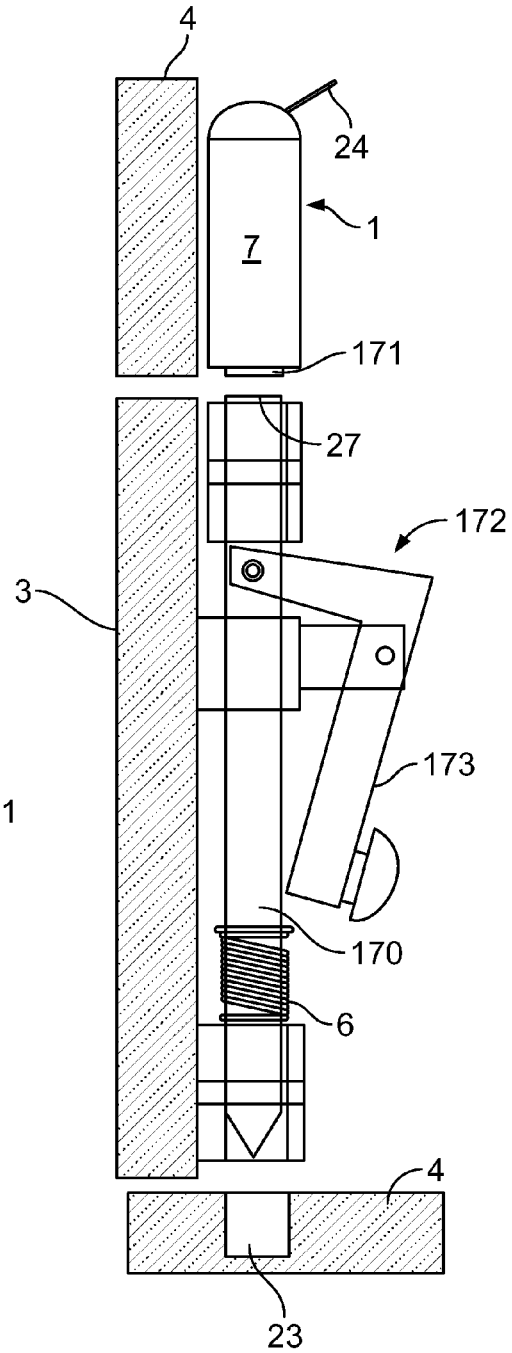
FIG. 16 is a side view of the mechanism of FIG. 15.

In FIGS. 15 and 16, there is shown the emergency barrier 3 in FIGS. 13 and 14, however, a manual barrier release mechanism 172 is added. In this embodiment, the manual release mechanism 172 includes a levered handle 173 coupled to the barrier latch 170 whereby a predetermined force is manually applicable to the handle 173 which forces the barrier latch 170 to be moved to the open position and which also forces the primary latch 171 to be moved clear of the upper marginal edge of the barrier 3.

It can be seen that a plurality of barrier release mechanisms 1 can be disposed in a premises, each being actuatable by the same alarm or predetermined condition, or independently. In the case of emergencies, loss pressure to the latch actuation device 7 results in the latches 2 and hence the barriers being released and free to move. This is advantageous in the case of emergency entry or egress being required, for example during a fire. It can further be seen that the barrier release system 1 can be connected to any preferred type of fluid pressure source which can be selectively pressurized or depressurised.

Similarly, a plurality of barrier release mechanisms 1 can be applied to different types of barriers in the same system (not illustrated), for example, a barrier release mechanism attached to a plurality of doors in a premises as well as a plurality of windows.

Although not illustrated in the drawings, the barrier release mechanism 1 is suitably applicable to linearly moveable doors, for example train doors or the like, which are driven by a linear actuator. In such embodiments, the latch 2 of the barrier release mechanism 1 is configured to disengage the linear actuator from the train door when the latch 2 is moved to the disengaged position to allow the door to move independently of the linear actuator, and to engage the linear actuator to the train door when the latch is moved to the engaged position. In such cases, the train door linear actuator will be biased into the disengaged position. It is also noted that the barrier release mechanism 1 may engage a clutch intermediate so as to engage the train door linear actuator.

Similarly in the case of rotating door driven by a rotational actuator the latch of the barrier release system 1 is configured to disengage the rotating door rotational actuator from the door when the latch 2 is moved to a disengaged position and to thereby allow the rotating door to rotate independently of the rotational actuator, and to engage the rotational actuator to the rotating door when the latch is moved to the engaged position to allow the door to be rotated. As with the linear moving door embodiment, the barrier release system may be engaged to a clutch which is in turn engages to the rotating door rotational actuator.

According to an example (not shown) a barrier release system includes a plurality of barrier release mechanisms. The release mechanisms are disposed adjacent a barred metal door or window barrier, built into the strike plate on a door barrier, disposed adjacent a linear or rotating door and disposed adjacent a hinge of a barrier to disengage it from the barrier or a barrier frame. However, any other barriers and corresponding barrier release mechanisms can be added to the system.

In the latter embodiment, barrier hinges are engaged with one or more latches such that loss of pressure to the latch actuation devices allows the latches to become disengaged allowing the barrier to be moved.

The pressure control valves each provide a means by which the latch actuation device of each mechanism can be depressurised so as to allow release of each barrier. The barrier release mechanism also includes a pressure indicator to indicate the state of pressurisation of the latch actuation devices in each mechanism.

It is noted that the barrier release mechanism 1 can likewise be used on roller or sliding shutter barriers. Typically, the shutters move along a substantially U-shaped guide channel mounted to a support frame. The mechanism 1 is configured to be mounted to the guide channel wherein engagement of the latch activation device causes the channel guide to be retained to the support frame and disengagement of the latch actuation device causes the channel guide to become disengaged from the support frame where the shutter is free to move.

The foregoing describes only a preferred embodiment of the present invention and modifications, obvious to those skilled in the art, can be made thereto without departing from the scope of the present invention.

The invention claimed is:

1. A barrier release mechanism for a barrier construction which includes a barrier and a barrier frame, the barrier release mechanism comprising:

at least one barrier latch having a latching position and an unlatching position and biasing means to bias the at least one barrier latch towards the unlatching position, the barrier release mechanism further including:

a latch actuation device which is disposed adjacent to the barrier construction and movable between an engaged position in which the latch actuation device is in abutment with the at least one barrier latch to urge the at least one barrier latch against the bias of the biasing means into the latching position to cause the barrier to be constrained, and a disengaged position in which the latch actuation device enables the at least one barrier latch to be moved by the biasing means from the latching position to the unlatching position whereby the at least one barrier latch does not cause the barrier to be constrained;

a source of fluid pressure in fluid communication with the latch actuation device; and a pressure control valve disposed fluidly intermediate the latch actuation device and the source of fluid pressure, the pressure control valve being configured for controlling pressure applied from the source of fluid pressure to the latch actuation device;

wherein biasing of the at least one barrier latch with the biasing means is independent from the latch actuation device; and wherein the application of a predetermined fluid pressure from the source of fluid pressure to the latch actuation device causes the latch actuation device to move into the engaged position and a predetermined reduction of fluid pressure to the latch actuation device allows the latch actuation device to move to the disengaged position.

2. The barrier release mechanism according to claim 1, wherein the barrier latch includes a latching portion which effects constraining of the barrier when the at least one barrier latch is in the latching position, the latching portion being adapted to move in an actuation direction as the at least one barrier latch moves into the latching position, the at least one barrier latch having an actuation surface which is at a rear extremity of the at least one barrier latch with respect to said latching direction when the at least one barrier latch is in the unlatching position, the latch actuation device, in the engaged position, being adapted to abut the actuation surface.

3. The barrier release mechanism according to claim 1, wherein the latch actuation device includes a flexible-walled bladder which is inflated by said fluid pressure when the latch actuation device is in the engaged position and which is at least partly deflated when the latch actuation device is in the disengaged position.

4. The barrier release mechanism according to claim 1, wherein the latch actuation device includes a piston.

5. The barrier release mechanism according to claim 1, wherein the latch actuation device includes a diaphragm, or pressure chamber.

6. The barrier release mechanism according to claim 1, wherein the source of fluid pressure is at least one of a compressed fluid cylinder, fluid compressor, fluid ram, reticulated fluid supply, or pressurized fluid supply.

7. The barrier release mechanism according to claim 1, wherein the pressure control valve is integral with the latch actuation device.

8. The barrier release mechanism according to claim 1, wherein the fluid is a liquid.

9. The barrier release mechanism according to claim 1, wherein the fluid is a gas.

10. The barrier release mechanism according to claim 1, wherein the pressure control valve is configured to be responsive to an alarm, and to cause depressurizing of the latch actuation device in response to triggering of the alarm.

11. The barrier release mechanism according to claim 1, wherein the biasing means includes one or more springs.

12. The barrier release mechanism according to claim 1, wherein the at least one barrier latch is a door locking pin.

13. The barrier release mechanism according to claim 1, wherein the at least one barrier latch is in the form of a linear actuator, and the barrier is a door mounted to be linearly movable, wherein, when the linear actuator is in the latching position, it is adapted to engage the door to urge the door in linear motion, and when in the unlatching position is disengaged from the door such that the door is unconstrained thereby.

14. The barrier release mechanism according to claim 1, wherein the at least one barrier latch is in the form of a rotational actuator, and the barrier is a door mounted to be rotationally movable, wherein when the rotational actuator in the latching position, it is adapted to engage the door to urge the door in rotational motion, and when in the unlatching position is disengaged from the door such that the door is unconstrained thereby.

15. The barrier release mechanism according to claim 1, including a manual override actuator adapted, on application of a manual actuating force, to urge the at least one barrier latch from the latching position to the unlatching position when the latch actuation device is in the engaged position.

16. The barrier release mechanism according to claim 1, including a strike plate component mounted on the barrier frame, the strike plate component having a strike plate catch for engaging with a securement latch on the barrier to secure the barrier to the strike plate component, and wherein the at least one barrier latch, when in the latching position, locks the strike plate component to the barrier frame for constraining the barrier, and when in the unlatching position releases the strike plate component from the barrier frame to enable the strike plate component to be detached from the barrier frame thereby releasing the barrier from the barrier frame when the securement latch is engaged with the strike plate catch.

17. A barrier release mechanism for a barrier construction which includes a barrier and a barrier frame, the barrier release mechanism comprising:

at least one barrier latch having a latching position and an unlatching position and biasing means to bias the barrier latch towards the unlatching position, the barrier release mechanism further including:

a latch actuation device which is disposed adjacent to the barrier construction and movable between an engaged position in which the latch actuation device is in abutment with the at least one barrier latch to urge the at least one barrier latch against the bias of the biasing means into the latching position to cause the barrier to be constrained, and a disengaged position in which the latch actuation device enables the at least one barrier latch to be moved by the biasing means from the latching position to the unlatching position whereby the at least one barrier latch does not cause the barrier to be constrained;

a source of fluid pressure in fluid communication with the latch actuation device; and a pressure control valve disposed fluidly intermediate the latch actuation device and the source of fluid pressure, the pressure control valve being configured for controlling pressure applied from the source of fluid pressure to the latch actuation device;

wherein the latch actuation device includes a flexible-walled bladder which is inflated by the fluid pressure when the latch actuation device is in the engaged position and which is at least partly deflated when the latch actuation device is in the disengaged position; and wherein the application of a predetermined fluid pressure from the source of fluid pressure to the latch actuation device causes the latch actuation device to move into the engaged position and a predetermined reduction of fluid pressure to the latch actuation device allows the latch actuation device to move to the disengaged position.

18. A barrier release mechanism for a barrier construction which includes a barrier and a barrier frame, the barrier release mechanism comprising:

at least one barrier latch having a latching position and an unlatching position and biasing means to bias the barrier latch towards the unlatching position, the barrier release mechanism further including:

a latch actuation device which is disposed adjacent to the barrier construction and movable between an engaged position in which the latch actuation device is in abutment with the at least one barrier latch to urge the at least one barrier latch against the bias of the biasing means into the latching position to cause the barrier to be constrained, and a disengaged position in which the latch actuation device enables the at least one barrier latch to be moved by the biasing means from the latching position to the unlatching position whereby the at least one barrier latch does not cause the barrier to be constrained;

a source of fluid pressure in fluid communication with the latch actuation device; and a pressure control valve disposed fluidly intermediate the latch actuation device and the source of fluid pressure, the pressure control valve being configured for controlling pressure applied from the source of fluid pressure to the latch actuation device;

wherein the biasing means is disposed intermediate the at least one barrier latch and the barrier frame; and wherein the application of a predetermined fluid pressure from the source of fluid pressure to the latch actuation device causes the latch actuation device to move into the engaged position and a predetermined reduction of fluid pressure to the latch actuation device allows the latch actuation device to move to the disengaged position.

* * * * *